US010596412B2

(12) United States Patent
Sinclair

(10) Patent No.: US 10,596,412 B2
(45) Date of Patent: Mar. 24, 2020

(54) FOREARM EXERCISE GRIP DEVICE

(71) Applicant: Folkfilm Productions Limited, Aboyne (GB)

(72) Inventor: Ben Sinclair, Aboyne (GB)

( * ) Notice: Subject to any disclaimer, the term of this patent is extended or adjusted under 35 U.S.C. 154(b) by 81 days.

(21) Appl. No.: 15/947,468

(22) Filed: Apr. 6, 2018

(65) Prior Publication Data

US 2019/0299054 A1 Oct. 3, 2019

(30) Foreign Application Priority Data

Mar. 27, 2018 (GB) ..... 1804855.3

(51) Int. Cl.
*A63B 23/16* (2006.01)
*A63B 21/055* (2006.01)

(52) U.S. Cl.
CPC ..... *A63B 23/16* (2013.01); *A63B 21/0557* (2013.01)

(58) Field of Classification Search
CPC ... A63B 21/05; A63B 21/055; A63B 21/0557; A63B 21/0552; A63B 21/16; A63B 21/00065; A63B 21/0414; A63B 21/072; A63B 21/40; A63B 21/4017; A63B 21/4019; A63B 21/4023; A63B 21/4041; A63B 21/4035; A63B 21/04; A63B 21/0407; A63B 23/14; A63B 23/16; F41B 3/00; F41B 3/02
USPC ..... 482/44, 46, 49
See application file for complete search history.

(56) References Cited

U.S. PATENT DOCUMENTS 2,205,161 A * 6/1940 Vick ..... A63B 23/16 482/49
5,087,032 A * 2/1992 Gresh ..... A63B 21/0004 482/50
5,529,550 A * 6/1996 Maycock, Jr. ..... A63B 21/0552 482/132

OTHER PUBLICATIONS

Bearing—Definition of Bearing by Merriam Webster <URL: https://www.merriam-webster.com/dictionary/bearing> (Year: 2019).*

* cited by examiner

*Primary Examiner* — Andrew S Lo
*Assistant Examiner* — Zachary T Moore

(57) ABSTRACT

A forearm exercise grip device that implements a frame with a gripping portion, bearings, and a band is used to exercise at least a user's forearm muscles. A connecting portion extends from opposing ends of the gripping portion and includes an arcuate bend that extends to bearings on each side of the connecting portion. An elastic band with a loop wraps around each respective bearing. A user places the gripping portion of the frame in his hand, and then extends his fingers to, depending on size of hand and strength, one or both of a proximal or distal section of the band. The user squeezes the band directionally toward the gripping portion, which thereby exercises the user's forearm and hand muscles.

8 Claims, 2 Drawing Sheets

FOREARM EXERCISE GRIP DEVICE

CROSS-REFERENCE TO RELATED APPLICATIONS

This application is a continuation of and claims foreign priority to Application Serial No. GB1804855.3, entitled "Forearm Exercise Grip Device," filed in the United Kingdom on Mar. 27, 2018, the entire contents of which is incorporated herein in its entirety.

BACKGROUND

Exercise equipment, including dumbbells, treadmills, and home gym machines, can take up large amounts of space in a user's home. In addition, exercise equipment can require numerous parts which make the manufacturing process difficult and costly.

SUMMARY

A forearm exercise grip having a frame that is indirectly connected to a band is used to strengthen a user's forearm. The frame can have a gripping portion and first and second connecting portions which extend on opposite ends of the gripping portion. The connecting portion has an arcuate bend at a substantially 68° angle from the gripping portion, which causes a portion of the connecting portion to extend in an orthogonal direction to the gripping portion. First and second bearings are attached to the respective first and second connecting portions.

The band is wrapped around each respective bearing. The band thereby extends in a like direction to the gripping portion and depending on the degree of angle can be parallel or substantially parallel. Once the band is secured around the bearings, the user grabs the gripping portion of the frame such that the gripping portion is positioned within the user's palm. The user then extends and reaches his fingers toward the band. The user can grab either the proximal section of the band or the distal section of the band. That is, the proximal section of the band is nearer to the gripping portion and the distal section is farther from the gripping portion relative to the proximal section.

The user can squeeze the band to strengthen the user's various muscles, such as the forearm and muscles in the hand. The gripping portion of the frame can enhance the user's grip and comfort of the device during regular use and also when the user is sweating. The present implementation allows multiple techniques to be executed and individual muscles activated separately, rather than all at once in a single in out motion as implemented with spring-loaded forearm exercise mechanisms. Individual forearm flexor and extensor muscles are engaged and tension can be switched from left to right on the hand to provide better results during a workout, rather than, in the spring-loaded mechanism, a single in and out technique. The Brachioradailis muscle is also engaged with the present forearm exercise grip.

DETAILED DESCRIPTION

The aspects, features and advantages of the present disclosure will be appreciated when considered with reference to the following description of preferred embodiments and accompanying figures. The following description does not limit the disclosure; rather, the scope is defined by the appended claims and equivalents. While certain processes in accordance with example embodiments are shown in the figures as occurring in a linear fashion, this is not a requirement unless expressly stated herein. Different processes may be performed in a different order or concurrently.

FIGS. 1-4 show various views of the forearm exercise grip 105. The forearm exercise grip includes a frame 110, which includes a gripping portion 115 and a connecting portion 120. The connecting portion 120 extends along opposite ends of the gripping portion of the frame. The frame may be manufactured of metal, plastic, or any suitable polymer to withstand sufficient pressure for exercise use as described herein.

The figures show gripping portion 115 being a distinct gripping mechanism for the forearm exercise grip, but it may alternatively be only the frame, in which case the gripping portion is the portion that the user grabs when using the forearm exercise grip. The gripping portion, which provides added user support during use, may be comprised of foam and fitted on the frame during the manufacturing process. Alternatively, the gripping portion 115 may be wrapped around and attached to the frame, such as using adhesive. In another example, the frame may include indentations and/or protuberances that provide increased grip support for the user during use. This may help the user with his grip, such as when sweating during a workout session, and for comfort.

Figure 4:
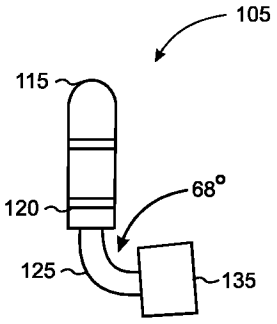
FIG. 4 shows a side view of the forearm exercise grip in accordance with aspects of the present disclosure.

The connecting portion 120 includes an arcuate shaped bend 125 at a 68° angle, thereby making a bearings-side section of the connecting portion extend in an orthogonal direction to the gripping portion. In this regard, the bearings-side section of the connecting portion may be positioned and extend anywhere up to and including perpendicular to the gripping portion, or otherwise in the orthogonal direction but not necessarily perpendicular, depending on the implementation. The connecting portion thereby extends and connects the frame from the gripping portion to the bearings 130. Although FIG. 4 depicts an angle of 68°, this degree is exemplary only and other degrees, such as between 50-110°, are also possible depending on the intended use and implementation. The employed 68° angle is to align the band with the gripping portion so that the user's hand stretched out hand is lined up with the band.

Connected to the connecting portion 120 is a pair of bearings 130 on respective sides of the connecting portions. The bearings may be sized according to 3×3×6 and comprised of plastic, metal, or other suitable polymer. The bearings may be affixed to or otherwise fastened to the connecting portion of the frame via various means, including press fit, shrink fit, friction fit, adhesive, and the like. As one example, the bearings are positioned around an outer diameter of the connecting portion. As an additional example, the bearings may be wider bearings, nylon bushes, plastic bearings, etc.

The band 135 is wrapped around each respective bearing 130 and once assembled the band is a distance away from the gripping portion 115. The distance is set so that a user's hand can simultaneously grip the gripping portion and the band. For example, the distance may be anywhere from 1-5 inches.

The band may be removable and replaceable and include at least some degree of elasticity to wrap around the bearings and to receive pressure from the user during the workout. As one example, the band may be comprised of a rubber material. The band is wrapped around the bearings so that the bearing physically touches and is engaged with an outer diameter of the bearings. Once assembled, the band extends in a like direction to the gripping portion 115.

The forearm exercise grip is not restricted to any particular size or resistance level, but rather any level of resistance can be utilized based on the employed band. For example, the level of elasticity, thickness, and resistance of the band may depend on the strength of the user, in that less resistant bands can be used for relatively weaker individuals, and relatively more resistant bands can be used for relatively stronger individuals.

Figure 3:
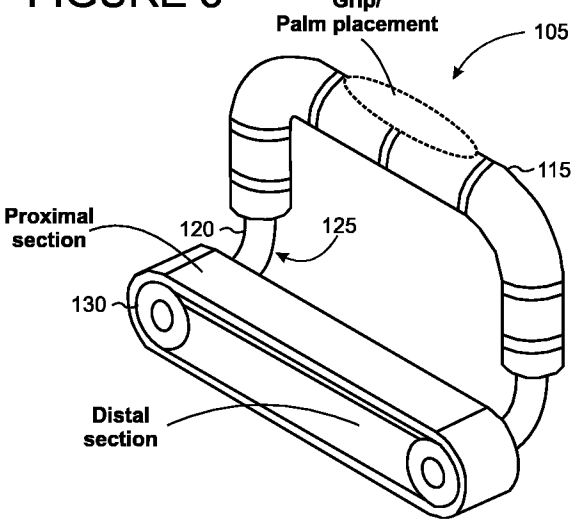
FIG. 3 shows a perspective view of the forearm exercise grip in accordance with aspects of the present disclosure.
Figure 1:
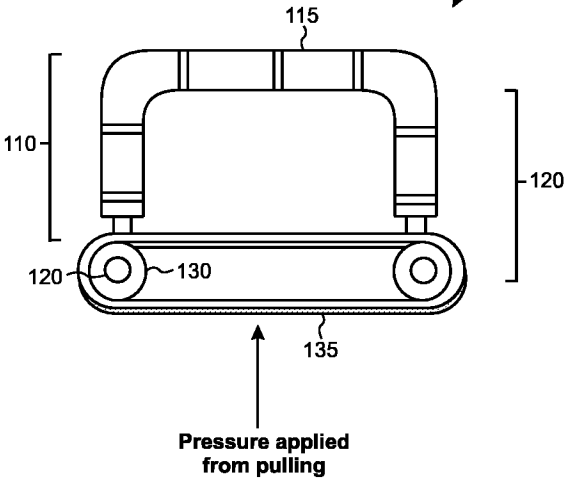
FIG. 1 shows a front view of the forearm exercise grip in accordance with aspects of the present disclosure.
Figure 2:
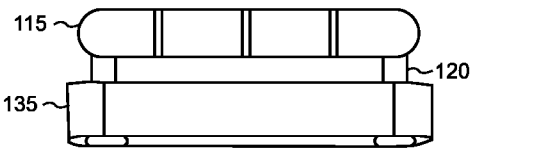
FIG. 2 shows a top view of the forearm exercise grip in accordance with aspects of the present disclosure.
Figure 5:
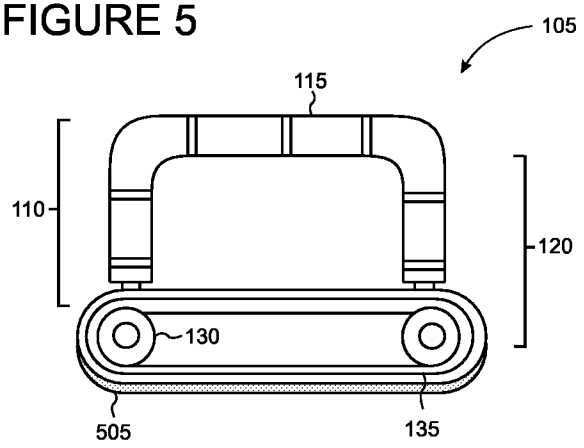
FIG. 5 shows the forearm exercise grip with multiple bands in accordance with aspects of the present disclosure.

In another example and as shown in FIG. 5, multiple bands can be placed on top of each other to increase resistance for the user. For example, FIG. 5 shows a second band 505 positioned on top of the original band 135. Thus, the forearm exercise grip can provide multiple bands, in which users who wish to increase resistance for their workout can add another band. The multiple bands can be the same type, shape, and resistance level, or alternatively varying levels of resistance bands can be placed on top of one another. Although FIG. 5 only shows one additional band, any number of bands can be added on top of each other, such as three, four, etc.

Once the forearm exercise grip is assembled, that is, the bands are placed over the bearings, the user can exercise his forearms with the forearm exercise grip. The user places the gripping portion 115 in his palm (as illustratively shown in FIG. 3), extends his fingers to grip the band 135, and then pulls the band directionally toward the gripping portion (as illustratively shown by the arrow in FIG. 1). The user can use the device by repeatedly pulling and releasing the band, or alternatively the user can pull and hold the band for a period of time. In addition, the user can grip only a single section of the band, such as the section proximal to the gripping portion, or alternatively the user can grip the distal section of the band. The proximal and distal sections are representatively shown in FIG. 3. For example, users with smaller hands or are relatively weaker may grab and exercise with the proximal section. In contrast, users with larger hands or are relatively stronger may grab and exercise with the distal section.

The present implementation allows multiple techniques to be executed and individual muscles activated separately, rather than all at once in a single in out motion as in spring-loaded forearm exercise mechanisms. Individual forearm flexor and extensor muscles are engaged and tension can be switched from left to right on the hand to provide better results during a workout, rather than, in the spring-loaded mechanism, a single in and out technique. The Brachioradailis muscle is also engaged during the workout.

As an alternative embodiment, instead of the band forming a loop that wraps around the respective bearings, the band may be affixed to respective ends of the connecting portion. The band may be permanently attached to the connecting portion, or removably attachable. For example, the band may be affixed to the connecting portion via any one or more of a clamp, clip, pin, bolt, screw, or buckle. In this regard, the band may be a single flat piece of material (i.e., not forming a loop), which is affixed to both ends of the connecting portions. One or multiple flat pieces of band may be attached via this method, which thereby allows the user to grab additional bands to increase or decrease resistance during his workout.

The present disclosure describes multiple embodiments. One embodiment includes a forearm exercise grip device, comprising: a frame having a gripping portion; a band indirectly connected to the frame which extends in a like direction to the gripping portion of the frame, the band being positioned a distance from the gripping portion, in which the band is configured to receive pressure in a direction toward to the gripping portion of the frame.

As another example, the band is elastic. In another example, the band is comprised of a rubber material. As another example, the forearm exercise grip device includes a bearing attached to the frame, in which the band physically touches and is engaged with the bearing. As another example, the frame further includes a connecting portion that connects the gripping portion to the bearing, such that the bearing is positioned on an outer diameter of the connecting portion. In another example, the connecting portion includes an arcuate bend, in which a bearing side of the connecting portion extends in an orthogonal direction to the gripping portion. As another example, the forearm exercise grip device further includes a second bearing, wherein the bearings are each positioned on respective connecting portions on opposite ends of the gripping portion of the frame. In another example, the band is removable and replaceable from the grip. As another example, the bands of varying thickness are attachable to the frame to provide varying resistance levels. In another example, the forearm exercise grip device further comprising multiple bands. In another example, the multiple bands overlap each other when connected to the forearm exercise grip device.

In an additional embodiment, an apparatus for strengthening a user's forearm is disclosed, comprising: a frame, comprising: a gripping portion; and a first and second connecting portion, wherein the first and second connecting portions are positioned on opposite ends of the gripping portion; a first and second bearing each attached to the respective first and second connecting portions of the frame; and a single band attached to the first and second bearings, in which the band extends in between the first and second bearings.

As another example, the band extends in a like direction to the gripping portion of the frame. In another example, the band and at least a portion of the gripping portion extend parallel to and are adjacent to each other. In another example, the band forms a loop and the loop wraps around a diameter of each of the respective first and second bearings.

In another embodiment, an exercise device is disclosed, comprising: a frame, comprising: a gripping portion; and a first and second connecting portion, wherein the first and second connecting portions are positioned on opposite ends of the gripping portion; a single flat band attached to the first and second connecting portions, in which the band at least partially extends in between the first and second bearings.

As another example, first and second ends of the band are affixed to the respective first and second connecting portions of the frame. As another example, the band is affixed to the connecting portion via any one or more of a clamp, clip, pin, bolt, screw, or buckle. In another example, the band extends in a like direction to the gripping portion. As another example, a bearings side of the connecting portion extends in an orthogonal direction to the gripping portion.

Most of the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. A forearm exercise grip device, comprising:

a frame having a gripping portion, bearing, and a connecting portion having a circular diameter that connects the gripping portion to the bearing, such that the bearing is positioned on an outer diameter of the connecting portion, and wherein the connecting portion includes an arcuate bend, in which a bearing side of the connecting portion extends in an orthogonal direction to the gripping portion; and a band indirectly connected to the frame which extends in a like direction to the gripping portion of the frame, wherein the band physically touches and is engaged with the bearing, the band being positioned a distance from the gripping portion, in which the band is configured to receive pressure in a direction toward the gripping portion of the frame.

2. The forearm exercise grip device of claim 1, wherein the band is elastic.

3. The forearm exercise grip device of claim 2, wherein the band is comprised of a rubber material.

4. The forearm exercise grip device of claim 1, further comprising a second bearing, wherein the bearings are each positioned on respective connecting portions on opposite ends of the gripping portion of the frame.

5. The forearm exercise grip device of claim 1, wherein the band is removable and replaceable from the grip device.

6. The forearm exercise grip device of claim 5, wherein bands of varying thickness are attachable to the frame to provide varying resistance levels.

7. The forearm exercise grip device of claim 1, further comprising multiple bands.

8. The forearm exercise grip device of claim 7, wherein the multiple bands overlap each other when connected to the forearm exercise grip device.

* * * * *